US008103429B2

(12) United States Patent
Sivasubramaniam et al.

(10) Patent No.: US 8,103,429 B2
(45) Date of Patent: Jan. 24, 2012

(54) SYSTEM AND METHOD FOR OPERATING A COMPRESSION-IGNITION ENGINE

(75) Inventors: Manthram Sivasubramaniam, Bangalore (IN); Paul Kenneth Houpt, Schenectady, NY (US); Roy James Primus, Niskayuna, NY (US); Sunil Shirish Shah, Bangalore (IN)

(73) Assignee: General Electric Company, Niskayuna, NY (US)

( * ) Notice: Subject to any disclaimer, the term of this patent is extended or adjusted under 35 U.S.C. 154(b) by 953 days.

(21) Appl. No.: 11/641,204

(22) Filed: Dec. 19, 2006

(65) Prior Publication Data

US 2008/0147295 A1 Jun. 19, 2008

(51) Int. Cl.
*F02D 41/26* (2006.01)

(52) U.S. Cl. ..... 701/109; 123/672; 123/676

(58) Field of Classification Search ..... 123/672, 123/674, 676, 677, 679, 435, 673, 703; 701/109, 701/111, 103–105; 60/274, 285, 286
See application file for complete search history.

(56) References Cited

U.S. PATENT DOCUMENTS

| | | | | |
|---|---|---|---|---|
| 5,709,196 | A * | 1/1998 | Coleman et al. | 123/672 |
| 5,765,372 | A * | 6/1998 | Mitobe et al. | 60/301 |
| 6,354,269 | B1 | 3/2002 | Saito et al. | |
| 6,360,159 | B1 * | 3/2002 | Miller et al. | 701/103 |
| 6,382,177 | B1 | 5/2002 | Saito | |
| 6,708,483 | B1 * | 3/2004 | Robichaux et al. | 60/286 |
| 7,334,400 | B2 * | 2/2008 | Yan et al. | 60/286 |
| 2002/0147558 | A1 * | 10/2002 | Seip et al. | 702/99 |
| 2004/0144082 | A1 | 7/2004 | Mianzo et al. | |
| 2006/0096273 | A1 | 5/2006 | Soliman et al. | |
| 2007/0012032 | A1 * | 1/2007 | Hu | 60/286 |

FOREIGN PATENT DOCUMENTS

| | | |
|---|---|---|
| EP | 0889222 | 1/1999 |
| EP | 0916830 A2 | 5/1999 |
| EP | 1391601 | 2/2004 |
| WO | WO 82/00857 A1 | 3/1982 |

OTHER PUBLICATIONS

RD 539042, Mar. 2009.*

* cited by examiner

*Primary Examiner* — Hai Huynh
(74) *Attorney, Agent, or Firm* — Joseph J. Christian

(57) ABSTRACT

A system includes a controller configured to estimate a brake specific nitrogen oxide emission of an engine based on a plurality of sensed parameters of the engine. The controller is also configured to control one or more control variables of the engine to reduce specific fuel consumption while ensuring compliance of brake specific nitrogen oxide emissions within predetermined limits.

15 Claims, 10 Drawing Sheets

SYSTEM AND METHOD FOR OPERATING A COMPRESSION-IGNITION ENGINE

BACKGROUND

The invention relates generally to a system and method for operating a compression-ignition engine and, more specifically, for controlling emissions.

Compression-ignition engines, such as diesel engines, operate by directly injecting a fuel (e.g., diesel fuel) into compressed air in one or more piston-cylinder assemblies, such that the heat of the compressed air lights the fuel-air mixture. The direct fuel injection atomizes the fuel into droplets, which evaporate and mix with the compressed air in the combustion chambers of the piston-cylinder assemblies. The fuel efficiency, exhaust emissions, and other engine characteristics are directly affected by the compression ratio, the fuel-air ratio, injection timing, ambient conditions, and so forth. Exhaust emissions include pollutants such as carbon monoxide, oxides of nitrogen (NOx), particulate matter (PM), and smoke generated due to incomplete combustion of fuel within the combustion chamber.

Unfortunately, fuel efficiency, exhaust emissions, and other operational characteristics are less than ideal. In addition, conventional techniques to improve one operational characteristic often worsen one or more other operational characteristic. For example, attempts to decrease specific fuel consumption often cause increases in various exhaust emissions. Existing emissions control schemes generally take a conservative approach to ensure emissions compliance, thereby resulting in unnecessarily low fuel efficiency. For example, existing emissions control schemes often use static look-up tables based on previous operational data. Unfortunately, the actual operation of the engine may vary significantly from the static look-up tables, particularly after significant use and wear on the engine and also due to engine power production variation. As a result, the engine exhaust emissions may be at greater or lesser levels than expected by the static look-up tables. Again, the specific fuel consumption is also affected by the emissions control schemes.

BRIEF DESCRIPTION

In accordance with one exemplary embodiment of the present invention, a system includes a controller configured to estimate a brake specific nitrogen oxide emission of an engine based on a plurality of sensed parameters. It should be noted that nitrogen oxide emissions include nitrogen monoxide (NO), nitrogen dioxide (NO2), and other oxides of nitrogen. The controller is also configured to control one or more control variables of the engine to maintain the brake specific nitrogen oxide emissions within predetermined limits.

In accordance with another exemplary embodiment of the present invention, a system includes a controller configured to perform closed-loop control of nitrogen oxide emissions of an engine to decrease specific fuel consumption while ensuring emissions compliance of the nitrogen oxide emissions.

In accordance with yet another exemplary embodiment of the present invention, a method includes estimating a brake specific nitrogen oxide emission of an engine based on a plurality of sensed parameters. The method also includes controlling one or more control variables of the engine to maintain the brake specific nitrogen oxide emissions within predetermined limits.

In accordance with yet another exemplary embodiment of the present invention, a computer-readable medium includes programming instructions disposed on the computer-readable medium, wherein the programming instructions include instructions to estimate a brake specific nitrogen oxide emission of an engine based on a plurality of sensed parameters. The programming instructions further include instructions to control one or more control variables of the engine to maintain the brake specific nitrogen oxide emissions within predetermined limits.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
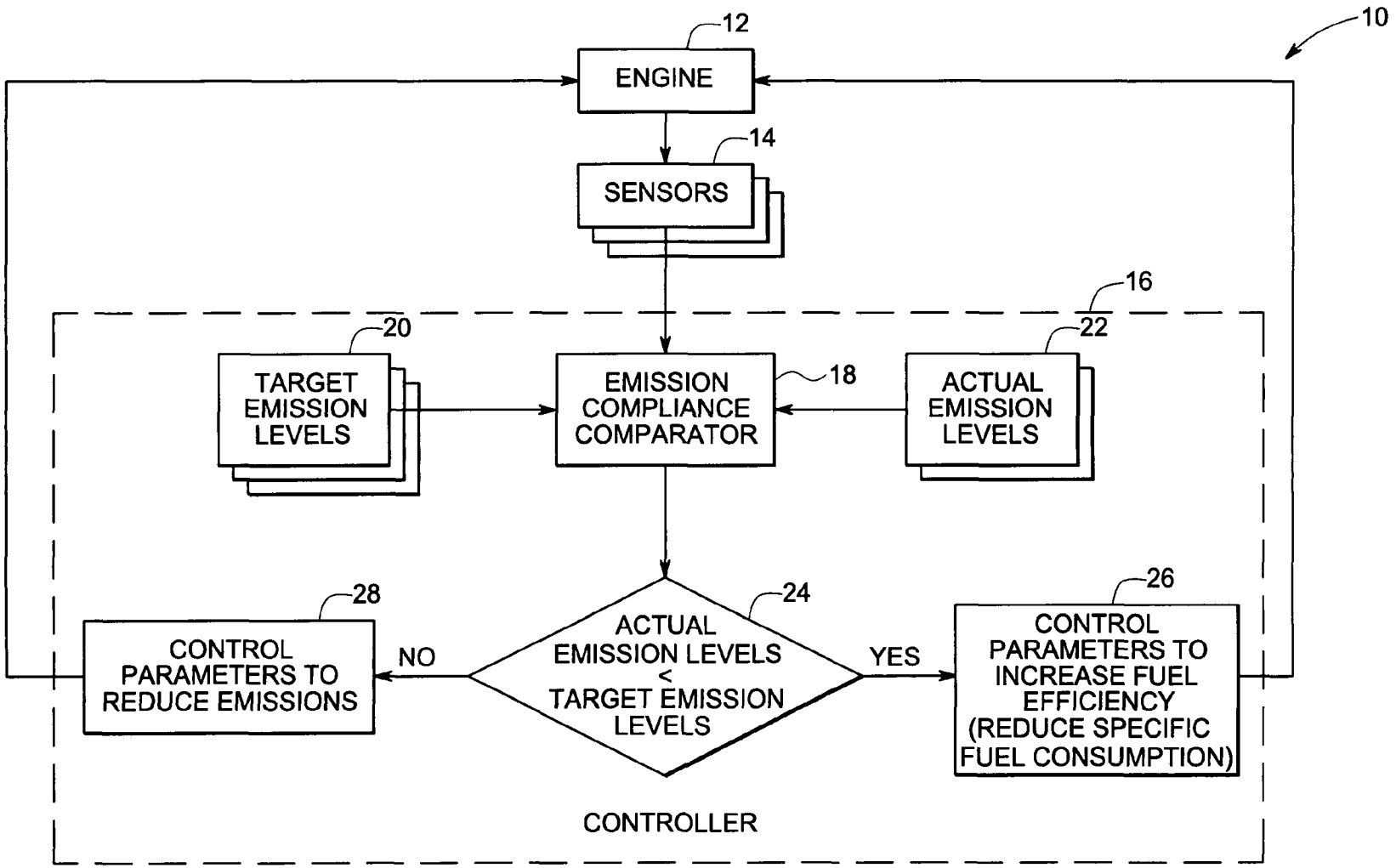
FIG. 1 is a diagrammatical representation of a power unit, such as a locomotive power unit, having engine exhaust emission and specific fuel consumption control features in accordance with an exemplary embodiment of the present technique.

Referring to FIG. 1, a power unit 10 (e.g. locomotive power unit) having engine exhaust emission and specific fuel consumption control features is illustrated in accordance with certain embodiments of the present technique. Specifically, as described in detail below, the disclosed embodiments are configured to reduce specific fuel consumption (SFC) by controlling actual exhaust emissions (e.g., brake specific nitrogen oxide emissions) more closely (e.g., smaller gap) to the predetermined limits, e.g., emissions standards set by the Environmental Protection Agency (EPA) or another regulatory authority. Thus, the disclosed embodiments use closed-loop control based on various engine feedback and estimations, such as the brake specific nitrogen oxide emissions. In certain exemplary embodiments, the power unit 10 may be used for other higher horsepower engine applications. As discussed in further detail below, embodiments of the present technique provide monitoring and control features, such as sensors and control logic, to control engine exhaust emissions and specific fuel consumption (SFC) within the locomotive power unit 10. For example, in the illustrated embodiment, the power unit 10 includes a compression-ignition engine, e.g. diesel engine 12, and a plurality of sensors 14 coupled to the engine 12. A controller 16 is communicatively coupled to the sensors 14. It should be noted that controller 16 may be a digital controller or a analog controller. The sensors 14 are configured to output a plurality of sensed parameters related to the engine 12 to the controller 16. The sensed parameters may include intake parameters, output parameters, and environmental conditions of the engine 12. For example, the intake parameters may correspond to air intake, fuel intake, ignition timing, and so forth. The output parameters may correspond to exhaust emissions, output horsepower, output torque, output speed, and so forth.

In the illustrated embodiment, the controller 16 includes an emission compliance comparator 18 configured to compare estimated actual brake specific nitrogen oxide emission (BS-NOX) levels 22 with a predetermined target brake specific nitrogen oxide emission levels 20 for each discrete notch among a plurality of throttle notches of the engine 12. The estimation of the actual brake specific nitrogen oxide emission levels is explained in greater detail with reference to subsequent figures below. The comparison step is represented by the block 24. If the estimated brake specific nitrogen oxide emission levels 22 is less than the predetermined target brake specific nitrogen oxide emission levels 20, the controller 16 controls one or more control variables of the engine 12 to increase fuel efficiency as represented by the block 26. If the estimated brake specific nitrogen oxide emission levels 22 is greater than the predetermined target brake specific nitrogen oxide emission levels 20, the controller 16 controls one or more control variables of the engine 12 to reduce engine exhaust emissions as represented by the block 28. The control variables include fuel injection timing, inlet manifold air temperature, or a combination thereof of the engine. In certain other embodiments, the control variables may include engine power, speed of the engine, turbo boost pressure, valve timing, exhaust pressure, or the like.

Figure 2:
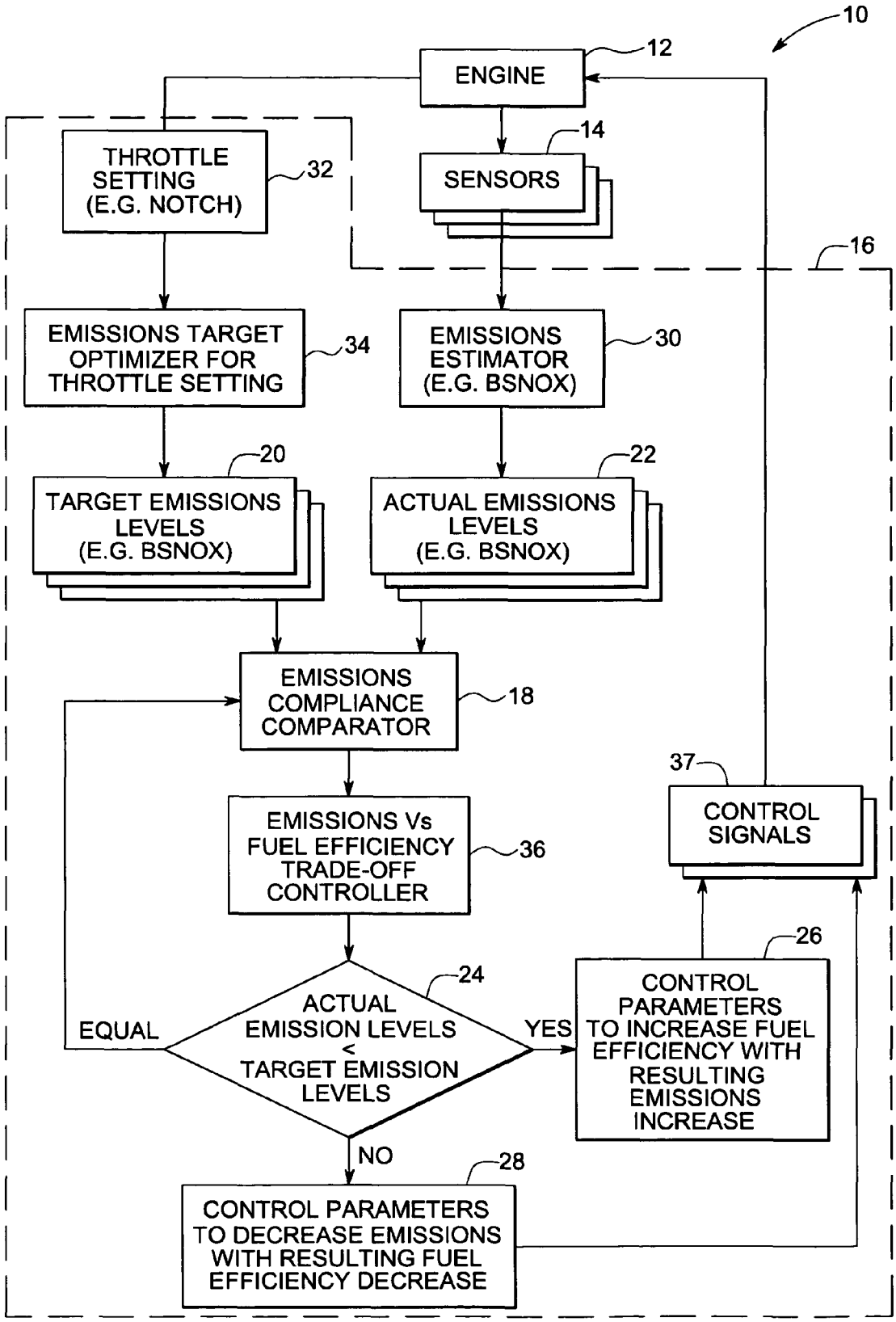
FIG. 2 is a diagrammatical representation of a power unit, such as a locomotive power unit, having engine exhaust emission and specific fuel consumption control features in accordance with the aspects of FIG. 1.

Referring to FIG. 2, the power unit 10 having engine exhaust emission and specific fuel consumption control features is illustrated in accordance with an exemplary embodiment of the present technique. As discussed above, the controller 16 is communicatively coupled to the sensors 14. The sensors 14 are configured to output a plurality of sensed parameters related to the engine 12 to the controller 16. The sensors 14 may include a nitrogen oxide (NOX) sensor configured to measure the nitrogen oxide emissions in parts per million (ppm) of exhaust gas emitted from the engine 12. It should be noted that nitrogen oxide emissions include nitrogen monoxide (NO), nitrogen dioxide (NO2), and other oxides of nitrogen. Since the NOX sensor detects the relative amount of NOX in the exhaust gas stream, the NOX measured in ppm is converted to brake specific nitrogen oxide emissions to compute the actual mass flow of NOX in the exhaust gas stream. The controller 16 includes an emission estimator 30 configured to estimate the actual brake specific nitrogen oxide emission levels 22 based on the measured nitrogen oxide emissions in parts per million and other sensed parameters of the engine. The actual brake specific nitrogen oxide emissions are calculated as follows. The molar fraction of carbon compounds in the exhaust gas stream is calculated based on the following relation:

$$\text{Mole fraction}(X) = \left(\frac{CO_2}{100} + \frac{ppm_{HC}}{10^6} + \frac{ppm_{co}}{10^6}\right)$$

where CO2 is the percent concentration of carbon dioxide, $ppm_{HC}$ is the parts per million concentration of hydrocarbon, $ppm_{CO}$ is the parts per million concentration of carbon monoxide. The number of moles of exhaust is calculated based on the following relation:

$$\text{Moles of fuel} = \frac{W_f \times 454}{MW_{fuel}}$$

$$\text{Moles of exhaust}/hr = \frac{\text{Moles of fuel}}{X}$$

where $W_f$ is the fuel flow rate, and $MW_{fuel}$ is the molecular weight of the fuel, X is the molar fraction of carbon compounds in the exhaust gas stream, 454 is a constant to convert pounds per hour to grams per hour. The number of moles of $NO_X$ in the exhaust gas stream is calculated based on the following relation:

$$\frac{ppm_{NOX}}{10^6} = \frac{NO_X \text{moles}/hr}{\text{Exhaust moles}/hr}$$

$$\text{Moles of } NO_X/hr = ppm_{NOX} \times \text{moles of exhaust}/hr/10^6$$

where $ppm_{NOX}$ is the concentration of $NO_x$. The moles of $NO_X$ is converted to grams of $NO_X$ based on the following relation:

$$E_{NOX}(\text{grams}/hr) = K_{NOX} \times MW_{NO2} \times \text{number of moles of } NO_X/hr \times 454$$

$$E_{NOX} = \frac{K_{NOX} \times MW_{NOX} \times \frac{ppm_{NOX}}{10^6} \times W_f \times 454}{MW_{fuel} \times X}$$

where $MW_{NOX}$ is the molecular weight of $NO_X$, $K_{NOX}$ is the correction factor and is dependent on inlet air temperature and relative humidity. The grams of $NO_X$ calculation is normalized based on the relation below:

$$BSNOX(\text{grams}/HP - hr) = \frac{E_{NOX}}{HP}$$

where HP is the engine horse power.

The power unit 10 may include a plurality of discrete (e.g., notch) throttle settings 32 for the engine 12. In certain exemplary embodiments, the power unit 10 may include eight discrete notch settings of the engine 12. The controller 16 includes an emission target optimizer 34 configured to calculate optimal target brake specific nitrogen oxide emission levels 20 for each discrete notch of the engine 12 so as to maintain overall average weighted nitrogen oxide emissions within predetermined limits. In certain exemplary embodiments, the average weighted nitrogen oxide emissions are maintained at 5.5 grams per horse power-hour. The optimal target brake specific nitrogen oxide emissions may be calculated based on engine operating conditions and the environmental conditions of the engine 12. The controller 16 includes the emission compliance comparator 18 configured to compare the estimated actual brake specific nitrogen oxide emission (BSNOX) levels 22 with the predetermined target brake specific nitrogen oxide emission levels 20 for each discrete notch among a plurality of throttle notches of the engine 12. In the illustrated embodiment, controller 16 may include a trade-off controller 36 configured to control the one or more control variables of the engine 12 so as to decrease specific fuel consumption by reducing a gap between the estimated brake specific nitrogen oxide emissions 22 and the predetermined target brake specific nitrogen oxide emissions 20 of the engine.

Again as discussed with reference to FIG. 1, the comparison step is represented by the block 24. If the estimated brake specific nitrogen oxide emission levels are less than the predetermined target brake specific nitrogen oxide emission levels, the controller 16 generates control signals 37 to control one or more control variables of the engine 12 to increase fuel efficiency with resulting emission increase as represented by the block 26. If the estimated brake specific nitrogen oxide emission levels is greater than the predetermined target brake specific nitrogen oxide emission levels, the controller 16 generates control signals 37 to control one or more control variables of the engine 12 to reduce engine exhaust emissions with resulting decrease in fuel efficiency as represented by the block 28. As appreciated, the nitrogen oxide emissions and the specific fuel consumption have an inverse relation. In other words, a reduction in brake specific nitrogen oxide emissions results in an equivalent increase in specific fuel consumption. It should be noted herein that the exemplary controller 16 performs a closed-loop control of nitrogen oxide emissions of the engine 12 so as to decrease specific fuel consumption while ensuring emission compliance of the nitrogen oxide emissions.

Figure 3:
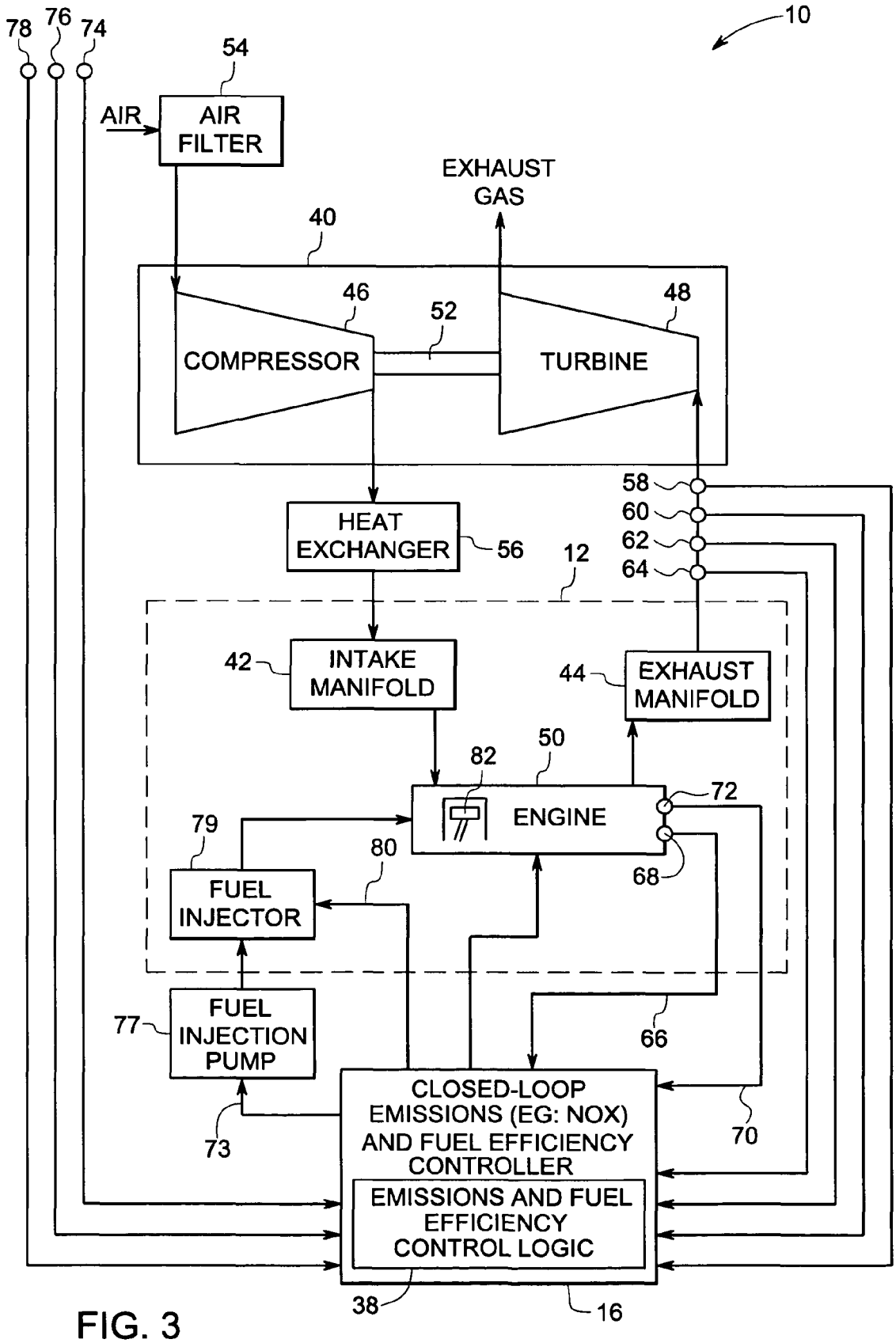
FIG. 3 is a diagrammatical representation of a turbocharged engine, such as a locomotive power unit, having engine exhaust emission and specific fuel consumption control features in accordance with an exemplary embodiment of the present technique.

Referring to FIG. 3, a turbocharged system (e.g., locomotive power unit) 10 having engine exhaust emission and fuel efficiency control logic 38 is illustrated in accordance with certain embodiments of the present technique. The locomotive power unit 10 includes a turbocharger 40 and the compression-ignition engine, e.g. diesel engine 12. As discussed in further detail below, embodiments of the present invention provide monitoring and control features, such as sensors and control logic, to control engine exhaust emissions while optimizing specific fuel consumption (SFC) within the locomotive power unit 10. For example, brake specific nitrogen oxide emission of the engine 12 is estimated based on a plurality of sensed parameters, and one or more control variables of the engine is controlled to maintain the brake specific nitrogen oxide emissions within predetermined limits based at least in part on the estimated BSNOx emission. The sensed parameters may include exhaust gas parameters, fuel flow rate, output power, and environmental conditions of the engine 12. The control variables include fuel injection timing, an inlet manifold air temperature, engine power, speed of the engine, or a combination thereof of the engine.

The illustrated engine 12 includes an air intake manifold 42 and an exhaust manifold 44. The turbocharger 40 includes a compressor 46 and a turbine 48 and is operated to supply compressed air to the intake manifold 42 for combustion within a cylinder 50. The turbine 48 is coupled to the exhaust manifold 44. The exhaust gases ejected from the exhaust manifold 44 are expanded through the turbine 48, thereby forcing rotation of a turbocharger shaft 52 connected to the compressor 46. The compressor 46 draws in ambient air through an air filter 54 and provides compressed air to a heat exchanger 56. The temperature of air is increased due to compression through the compressor 46. The compressed air flows through the heat exchanger 56 such that the temperature of air is reduced prior to delivery into the intake manifold 42 of the engine 12. In one embodiment, the heat exchanger 56 is an air-to-water heat exchanger, which utilizes a coolant to facilitate removal of heat from the compressed air. In another embodiment, the heat exchanger 56 is an air-to-air heat exchanger, which utilizes ambient air to facilitate removal of heat from compressed air. In yet another embodiment, the heat exchanger 56 utilizes a combination of a coolant and ambient air to facilitate removal of heat from compressed air.

The power unit 10 also includes the closed-loop emission and fuel efficiency controller 16. In one embodiment, the controller 16 is an electronic logic controller that is programmable by a user. In another embodiment, the controller 16 is an electronic fuel injection controller for the engine 12. The controller 16 receives a plurality of signals indicative of engine exhaust gas parameters including percentage of carbon dioxide, parts per million of nitrogen oxide emissions, parts per million of hydrocarbon, and parts per million of carbon monoxide from a carbon dioxide sensor 58, nitrogen oxide sensor 60, hydrocarbon sensor 62, and carbon monoxide sensor 64 respectively. The controller 16 also receives a flow rate signal 66 from a fuel flow rate sensor 68 and power signal 70 from an output power sensor 72 provided to the engine 12, and manifold pressure and temperature from a temperature sensor (74) and a pressure sensor 78. The controller 16 further receives a plurality of signals indicative of environmental conditions of the engine 12 such as relative humidity (H or RH), barometric pressure, and ambient temperature. The number and type of the illustrated sensors are not exclusive. In certain other embodiments, the power unit 10 may include other sensors such as oxygen sensor, engine speed sensor, manifold air pressure (MAP) sensor, inlet airflow rate sensor, or the like. The controller 16 is configured to estimate a brake specific nitrogen oxide emission based on the plurality of sensed parameters described and control one or more variables of the engine 12 to maintain the brake specific nitrogen oxide emission within predetermined limits. The control variables include fuel injection timing, inlet manifold air temperature, engine power, speed of the engine, or a combination thereof of the engine 12.

In certain exemplary embodiments, the actual brake specific nitrogen oxide emissions are calculated as follows using stoiciometric analysis. The analysis involves solving the following elemental balance equations using matrix inversion:

Carbon Balance: $y = a + f + g$

Oxygen Balance: $2z + x = 2a + b + 2c + 2d + g$

Hydrogen Balance: $2x + \propto y = 2b + f$

Nitrogen balance: $7.54z = c + 2e$ $$ppm_{NOX} = \frac{c}{a + c + d + e + f + g}$$

$$ppm_{CO} = \frac{g}{a + c + d + e + f + g}$$

-continued $$ppm_{HC} = \frac{f}{a+c+d+e+f+g}$$

$$CO_2 \text{ fraction} = \frac{a}{a+c+d+e+f+g}$$

$$\text{Number of moles of fuel}(y) = \frac{W_f \times 454}{MW_f}$$

$$x = \frac{z \times H \times MW_{air}}{MW_{H_2O}}$$

where y is the fuel flow, H is the relative humidity, $MW_{air}$ is the molecular weight of air, $MW_{H2O}$ is the molecular weight of water, $\alpha$ is the hydrogen to carbon ratio, and a, b, c, d, e, f, g, x, y, z are 10 unknown molar values. The above linear equations are solved to calculate the number of moles of $NO_X$. The humidity correction factor ($K_{NOX}$) may be calculated as mentioned above with reference to FIG. 2. The brake specific nitrogen oxide emission is calculated based on the number of moles of $NO_X$.

In certain embodiments, the controller 16 is configured to control a fuel injection timing to maintain the brake specific nitrogen oxide emission within predetermined limits. The specific fuel consumption of the engine is also maintained within the predetermined limits. In the illustrated embodiment, the controller 16 may be operable to produce a pressure signal 73 to control operation of a plurality of fuel injection pumps 77. The pumps 77 drive a plurality of fuel injectors 79 for injecting fuel into the plurality of cylinders 50 of the engine 12. In the illustrated embodiment, the fuel injector 79 is an electrically actuated fuel injector. The fuel injector 79 typically injects fuel into the engine cylinder 50 as a function of a fuel injection signal 80 received from the controller 16. The fuel injection signal 80 may include waveforms that are indicative of a desired injection rate, desired fuel injection timing, quantity of fuel to be injected into the cylinder 50, or the like. A piston 82 is slidably disposed in each cylinder 50 and reciprocates between a top dead center and a bottom dead center position. If the injection timing is advanced (i.e. inject before top dead center), the pressure and temperature of gases in the cylinder 50 increases, resulting in an increase in the engine exhaust emissions. However, engine 12 generates higher power for same amount of fuel. By advancing the fuel injection timing a certain amount, a lower quantity of fuel is required to produce the same power while maintaining the engine exhaust emissions within predetermined limits. Although the emissions (e.g., BSNOx) generally increase by some amount in response to the advanced timing, the disclosed embodiments ensure that the emissions do not exceed the predetermined limits. In other words, the advanced timing results in a smaller gap between the estimated/actual BSNOx and the predetermined limits (e.g., set by emissions standards/regulations).

Figure 4:
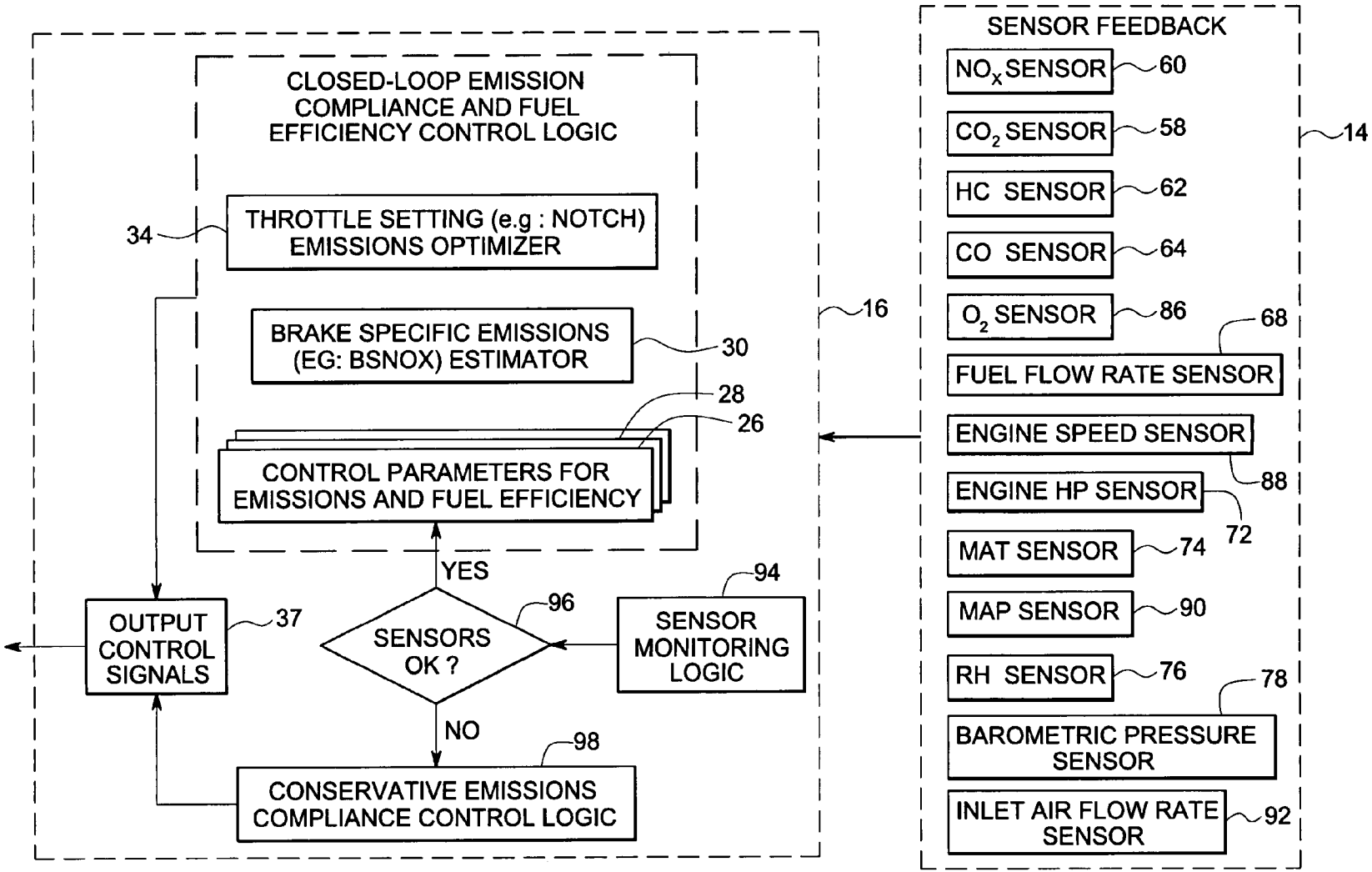
FIG. 4 is a diagrammatical representation of engine exhaust emission and fuel efficiency control logic features in accordance with an exemplary embodiment of the present technique.

Referring to FIG. 4, the controller 16 having engine exhaust emission and fuel efficiency control logic 38 is illustrated in accordance with embodiments of the present technique. As illustrated, the controller 16 receives sensor signals from a plurality of sensors, such as the NOX sensor 60, CO2 sensor 58, HC sensor 62, CO sensor 64, oxygen sensor 86, fuel flow rate sensor 68, engine speed sensor 88, engine horsepower sensor 72, manifold air temperature (MAT) sensor 74, manifold air pressure (MAP) sensor 90, inlet air flow rate sensor 92, relative humidity (RH) sensor 76, and barometric pressure sensor 78. The oxygen sensor 86 is configured to detect the quantity of oxygen in the exhaust gas. The speed sensor 88 is configured to detect speed of the engine. The MAP sensor 90 is configured to detect the pressure of air at the intake manifold 42 of the engine 12. Air flow rate sensor 92 is configured to detect the air flow rate at the intake manifold 42 of the engine 12.

As discussed previously, the controller 16 is communicatively coupled to the sensors 14. The sensors 14 are configured to output the plurality of sensed parameters related to the engine 12 to the controller 16. The controller 16 includes the emission estimator 30 configured to estimate the actual brake specific nitrogen oxide emission levels 22 based on the plurality of sensed parameters. The power unit 10 includes the plurality of discrete (e.g., notch) throttle settings for the engine 12. The controller 16 includes the emission target optimizer 34 configured to calculate optimal target brake specific nitrogen oxide emission levels for each discrete notch of the engine 12 so as to maintain an overall average weighted nitrogen oxide emissions within predetermined limits. The optimal target brake specific nitrogen oxide emissions may be calculated based on engine operating conditions and the environmental conditions of the engine 12. The estimated actual brake specific nitrogen oxide emission (BSNOX) levels are compared with the predetermined target brake specific nitrogen oxide emission levels for each discrete notch among a plurality of throttle notches of the engine 12. In the illustrated embodiment, controller 16 controls the one or more control variables of the engine 12 so as to decrease specific fuel consumption by reducing a gap between the estimated brake specific nitrogen oxide emissions 22 and the predetermined target brake specific nitrogen oxide emissions 20 of the engine.

The controller 16 generates control signals 37 to control one or more variables of the engine 12 based on the comparison of the estimated brake specific nitrogen oxide emission levels with the predetermined target brake specific nitrogen oxide emission levels. In certain exemplary embodiments, the controller 16 may include a sensor monitoring logic 94 configured to monitor operating conditions of the plurality of sensors 14. The sensor operating condition is checked as represented by block 96. If the sensor operating condition is normal, the controller 16 performs control of one or more control variables of the engine so as to control engine exhaust emissions and fuel efficiency of the engine as discussed above. If the sensor operating condition is abnormal, the controller 16 reverts to conservative settings that assure that engine exhaust emissions and fuel efficiency is maintained within predetermined limits. The controller 16 may include conservative emissions compliance control logic 98 configured to enable the controller 16 to revert to conservative settings.

Figure 5:
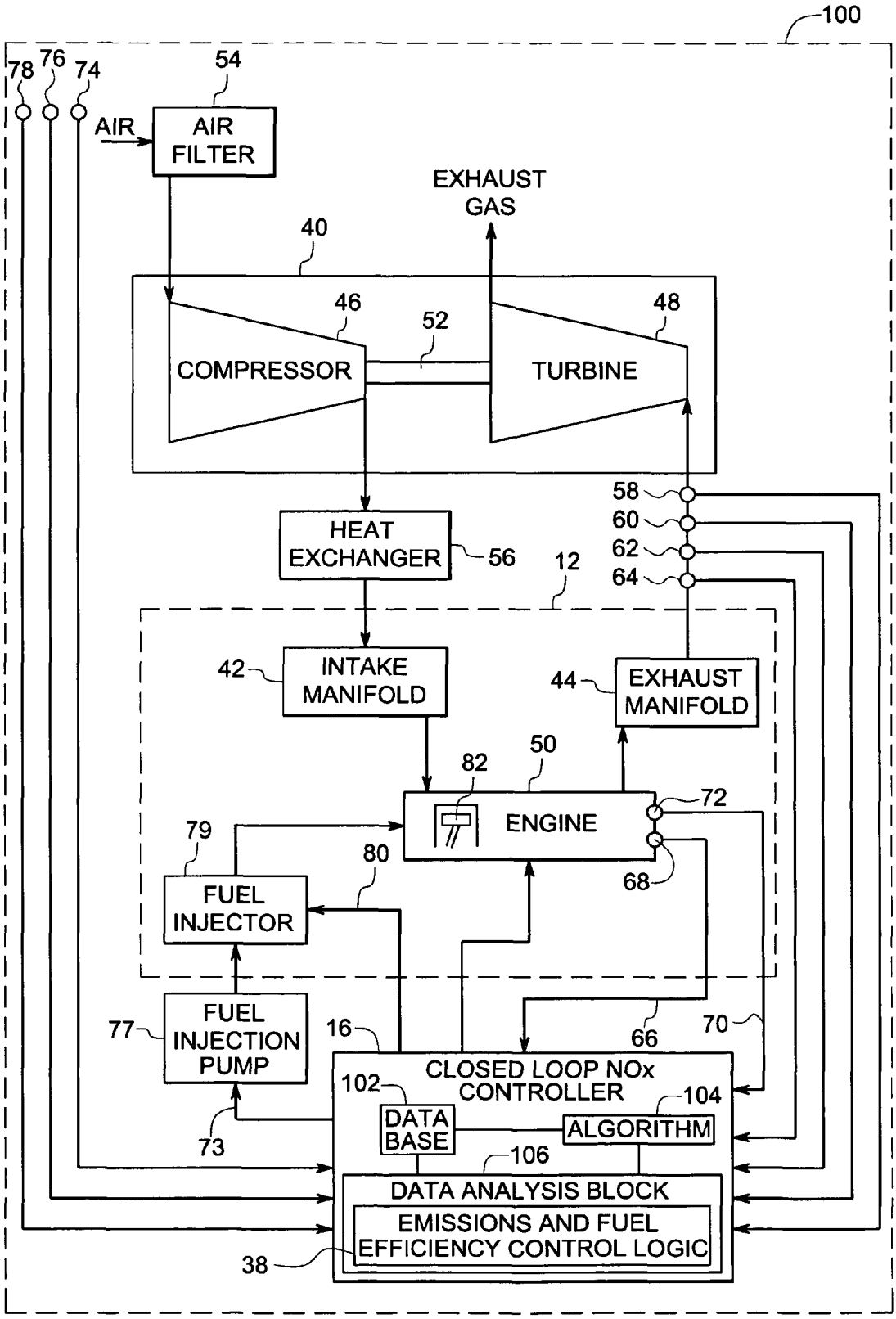
FIG. 5 is a diagrammatical representation of a system incorporating a turbocharged engine, such as a locomotive power unit, having engine exhaust emission and fuel efficiency control features in accordance with an exemplary embodiment of the present technique.

Referring to FIG. 5, one embodiment of the locomotive power unit 10 is illustrated. As illustrated above, the power unit 10 includes the turbocharger 40 and the diesel engine 14. The power unit 10 may be used for driving a system 100. The system 100 may include locomotive engine, automobile engine, marine engine, or the like. The system 100 also may include a vehicle, such as a locomotive, an automobile, a boat, an aircraft, and so forth. Furthermore, the system 100 may include a power generation system, industrial automation system, and so forth. The power unit 10 includes the controller 16. In the illustrated embodiment, the controller 16 receives sensor signals from a plurality of sensors, such as the $NO_X$ sensor 60, CO2 sensor 58, HC sensor 62, CO sensor 64, fuel flow rate sensor 68, engine horse power sensor 72, manifold air temperature (MAT) sensor 74, relative humidity sensor 76, and barometric pressure sensor 78. The controller 32 may be operable to produce the fuel injection signal 80 to control operation of the plurality of fuel injectors 79. In certain other embodiments, the controller 16 is configured to regulate control variables including injection timing, inlet manifold air temperature, engine power, speed of the engine, or a combination thereof of the engine. The controller 16 performs a closed-loop control of nitrogen oxide emissions of the engine 12 so as decrease specific fuel consumption while ensuring emission compliance of the nitrogen oxide emissions. Specifically, the controller uses various sensed data and estimated data (e.g., BSNOx) to control engine parameters to cause a decrease in the specific fuel consumption without raising the emissions (e.g., BSNOx) above the predetermined limits. In other words, the closed-loop control scheme may cause the actual BSNOx emissions to approach but not exceed the predetermined limits in order to reduce the specific fuel consumption.

In the illustrated embodiment, the controller 34 may further include a database 102, an algorithm 104, and a data analysis block 106. The database 102 may be configured to store predefined information about the power unit 10. For example, the database 102 may store information relating to fuel injection timing, engine speed, engine power, intake manifold air temperature, exhaust gas temperature, exhaust gas composition, or the like. The database 94 may also include instruction sets, maps, lookup tables, variables, or the like. Such maps, lookup tables, instruction sets, are operative to correlate characteristics of the fuel efficiency and nitrogen oxide emissions to specified engine operation parameters such as engine speed, fuel injection timing, intake manifold air temperature and pressure, exhaust gas composition, or the like. Furthermore, the database 94 may be configured to store actual sensed/detected information from the above-mentioned sensors. The algorithm 96 facilitates the processing of signals from the above-mentioned plurality of sensors.

The data analysis block 106 may include a variety of circuitry types, such as a microprocessor, a programmable logic controller, a logic module, etc. The data analysis block 106 in combination with the algorithm 96 may be used to perform the various computational operations relating to determination of brake specific nitrogen oxide emissions, fuel injection timing, fuel injection rate, number of fuel injections, the fuel injection quantity, timing, inlet manifold air temperature and pressure, engine power, speed of the engine, or a combination thereof. Any of the above mentioned parameters may be selectively and/or dynamically adapted or altered relative to time.

Figure 6:
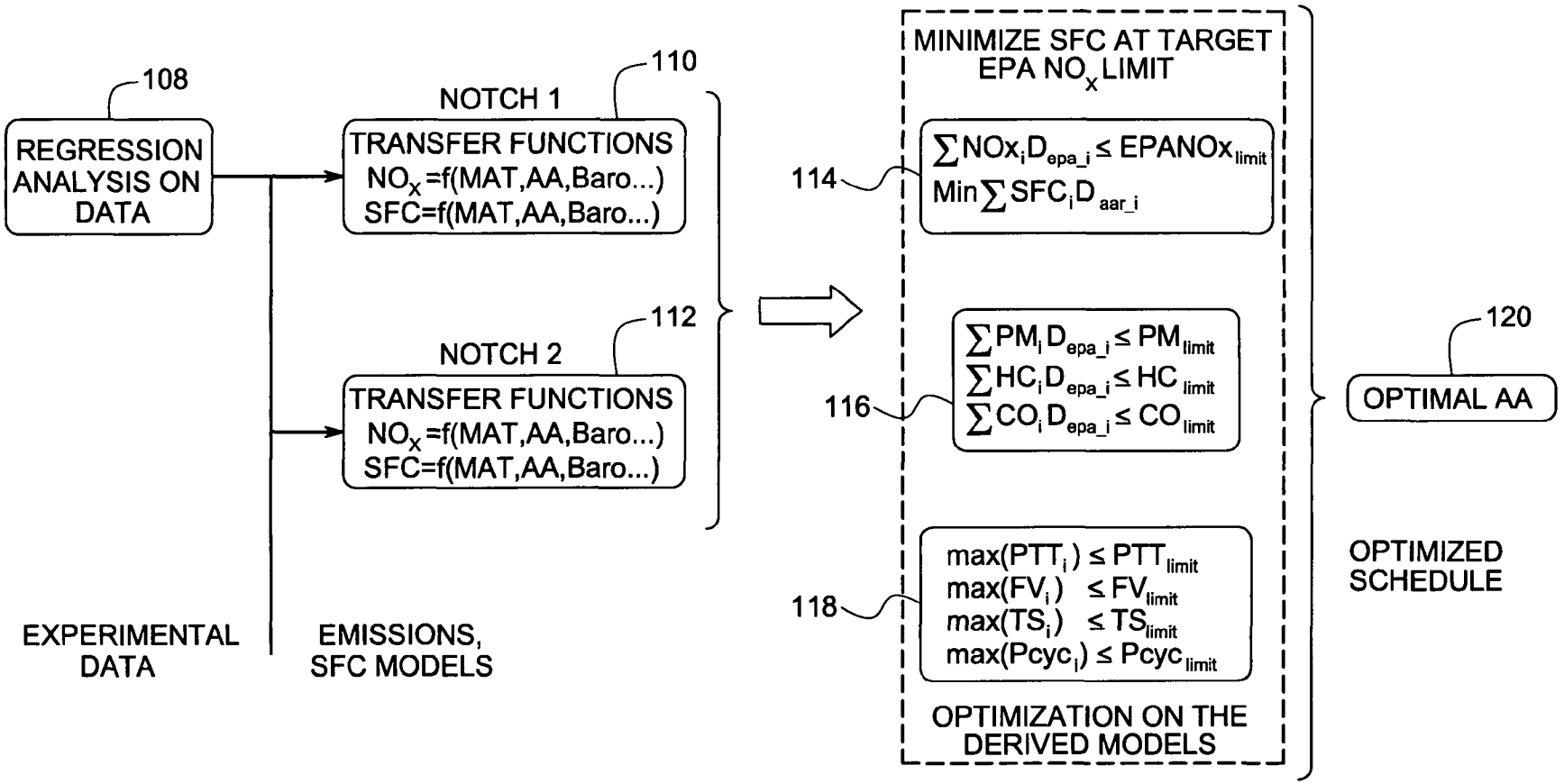
FIG. 6 is a diagrammatical representation illustrating steps involved in optimization of specific fuel consumption while maintaining emission compliance in accordance with an exemplary embodiment of the present technique.

Referring to FIG. 6, a diagrammatical representation of steps involved in optimization of specific fuel consumption while maintaining emission compliance is illustrated. The nitrogen oxide emissions of the engine are dependent on a plurality of factors including inlet manifold air temperature (MAT), advance angle (AA), barometric pressure, engine speed, engine horsepower, or the like. The technique involves performing design of experiments (DOE) and regression analysis to illustrate variation of advance angle versus nitrogen oxide emissions for a plurality of notches of the engine as represented by the block 108. The DOE and regression analysis facilitates to characterize the engine behavior for different operating conditions. The results of DOE are used to build a transfer function between parameters such as engine horsepower, advance angle, engine speed, manifold air temperature, barometric pressure and brake specific nitrogen oxide emissions. Regression analysis facilitates to decide structure of the transfer functions. Transfer functions for brake specific nitrogen oxide emissions (NOX) and specific fuel consumption (SFC) are represented by:

$$NO_x = f(\text{engine parameters, notch, } EPA \text{ duty cycle})$$

$$SFC = f(\text{engine parameters, notch, } AAR \text{ duty cycle})$$

The engine parameters may include manifold air temperature (MAT), advance angle (AA), barometric pressure, or the like. The transfer functions for plurality of notches, for example, notch 1, notch 2, or the like are represented by the blocks 110, 112.

An optimization model was derived so as to control specific fuel consumption while maintaining brake specific nitrogen oxide emissions within predetermined limits as represented by the block 114. The optimization model is represented as follows:

$$\Sigma NO_{Xi_i} D_{epa_i_i} \leqq EPANO_{XLimit}$$

$$\text{Min}\Sigma SFC_i D_{aar_i}$$

where $NO_{Xi}$ is the emission at notch "i", $D_{epa_i}$ is the EPA duty cycle (i.e. duty cycle set by the environmental protection agency), $SFC_i$ is the specific fuel consumption at notch "i", $D_{aar_i}$ is the AAR duty cycle. In certain exemplary embodiment, the $EPANO_{Xlimit}$ ($NO_X$ limit set by environmental protection agency) is equal to 5.5 grams per horse-power hour.

The exhaust emissions are maintained within predetermined limits as represented by block 116 and represented as follows:

$$\Sigma PM_i D_{epa_i} \leqq PM_{limit}$$

$$\Sigma HC_i D_{epa_i} \leqq HC_{limit}$$

$$\Sigma CO_i D_{epa_i} \leqq CO_{limit}$$

where $PM_i$ is the particulate matter emission at notch "i", $HC_i$ is the hydrocarbon emission at notch "i", $CO_i$ is the carbon monoxide emission at notch "i". The engine operating parameters are maintained within predetermined limits as represented by the block 118 and represented as follows:

$$\max(PTT_i) \leqq PTT_{limit}$$

$$\max(FV_i) \leqq FV_{limit}$$

$$\max(TS_i) \leqq TS_{limit}$$

$$\max(Pcyc_i) \leqq Pcyc_{limit}$$

where PTT is the pre-turbine temperature, FV is the fuel value, TS is the turbine speed, and Pcyc is the peak cylinder pressure. For normal operating conditions, manifold air temperature is constant for a predetermined notch. The brake specific nitrogen oxide emission varies with change in the advance angle. The specific consumption for the optimized advance angle 120 is calculated using the transfer functions.

Figure 7:
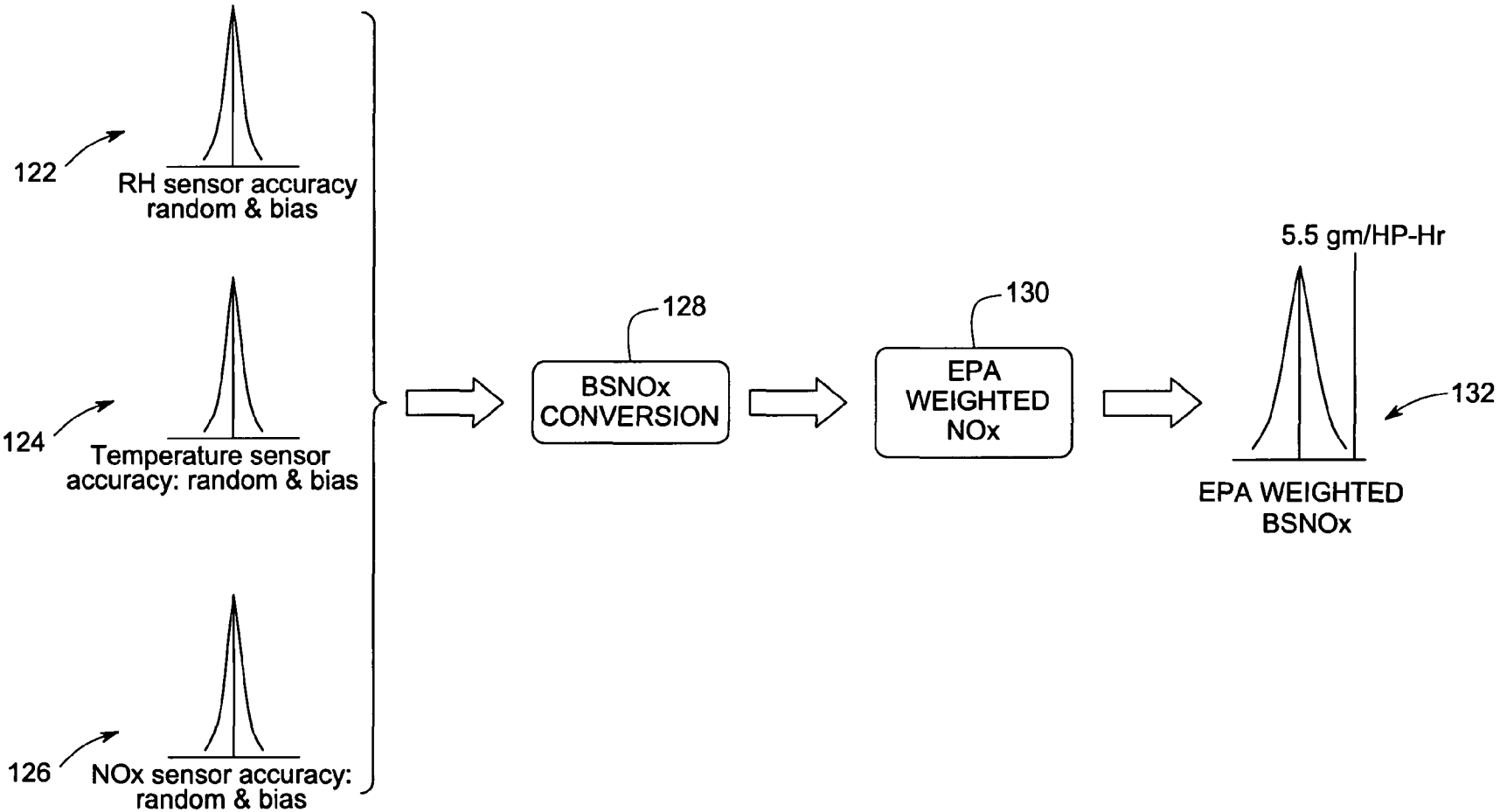
FIG. 7 is a diagrammatical representation of a Monte Carlo analysis technique configured to estimate sensor accuracy requirements in accordance with an exemplary embodiment of the present technique.

Referring to FIG. 7, diagrammatical representation of a Monte Carlo analysis technique configured to estimate sensor accuracy required in accordance with an exemplary embodiment of the present technique is illustrated. For each sensor, the standard deviation of sensor readings is estimated and a normal distribution is defined. In the illustrated embodiment, random and bias error of relative humidity sensor, temperature sensor, and NOX sensor, are represented as normal distributions 122, 124, 126 respectively. The brake specific nitrogen oxide emission is estimated for each notch settings based on the sensor readings of the relative humidity sensor, temperature sensor, and NOX sensor as described above and is represented by the block 128. The estimated brake specific nitrogen oxide emission for each notch settings may be represented as normal distribution. The resulting estimated brake specific nitrogen oxide emission distribution for each notch was weighed by the EPA duty cycle as represented by the block 130. A buffer value equivalent to 3 times sigma ($3\sigma$) is estimated from the resulting estimated brake specific nitrogen oxide emission distribution as represented by the normal distribution 132. The actual brake specific nitrogen oxide emissions are maintained within the buffer value.

Figure 8:
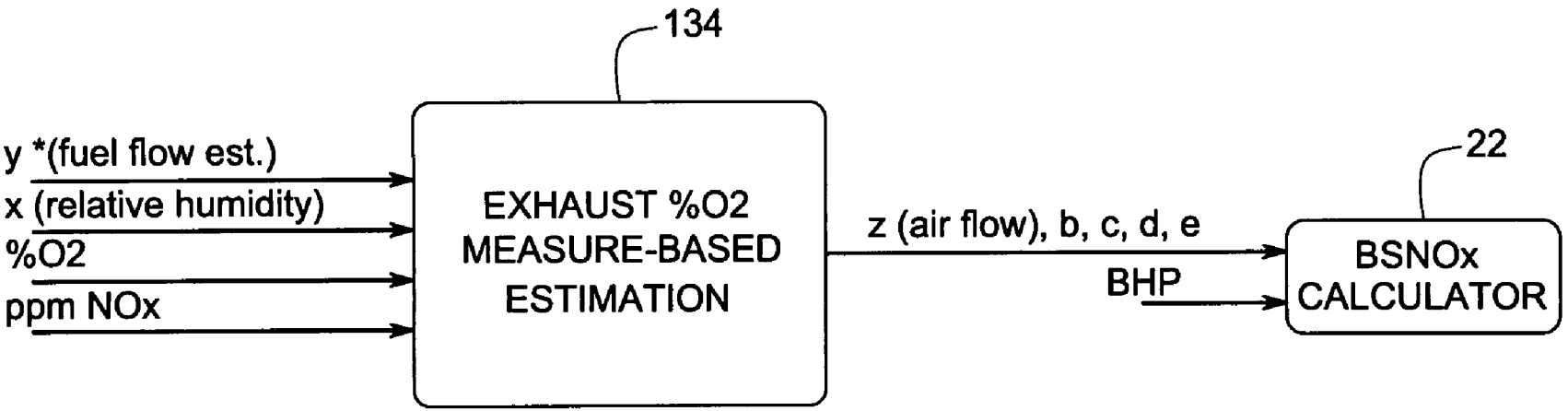
FIG. 8 is a diagrammatical representation of an oxygen based technique for estimation of a brake specific nitrogen oxide emission in accordance with an exemplary embodiment of the present technique.

Referring to FIG. 8, a diagrammatical representation of an oxygen-based technique for estimation of brake specific nitrogen oxide emission is illustrated. In the illustrated embodiment, the NOX sensor includes a Zirconia based oxygen sensor. In accordance with the exemplary technique, the quantity of oxygen in the exhaust gas stream is measured using the oxygen sensor. The nitrogen oxide emission (NOX) is dissociated to nitrogen and oxygen downstream of the oxygen sensor. The quantity of oxygen is again measured. The difference in quantity between the initial measurement and subsequent measurement of oxygen is equal to the concentration of NOX. Referring again to stoiciometric analysis explained in reference to FIG. 3, the concentration of oxygen is represented by the following relation:

$$O_2 \text{ fraction(dry)} = \frac{d}{a+c+d+e}$$

Alternatively, the brake specific nitrogen oxide emission may be estimated using airflow measurement represented by the following relation:

$$z = \frac{A_f \times 454}{MW_{air} \times 4.77}$$

where $A_f$ is the airflow rate, $MW_{air}$ is the molecular weight of air. In certain other exemplary embodiments, an alternate approach is to estimate airflow using existing sensors. Theoretical airflow ($Af_{theoretical}$) into the cylinders is calculated using displacement volume (Vd), density of intake air (ρ) and the engine rpm (N) as follows:

$$Af_{theoritical} = \frac{\rho \times V_d \times N}{2 \times 60}$$

The density of intake air may be calculated from ideal gas law if the inlet manifold air temperature and pressure are known. The theoritical airflow ($Af_{theoritical}$) is calculated based on the following relation:

$$Af_{theoritical} = \frac{MAP \times V_d \times N}{R \times MAT \times 2 \times 60}$$

where MAP is the manifold air pressure, MAT is the manifold air temperature, and R is a gas constant in joules/Kilogram/Kelvin. In actual practice there are losses due to flow across valves, inertia of the air mass or the like. The factors are lumped into what is known as the volumetric efficiency ($\eta_{vol}$) and is defined below:

$$\eta_{vol} = \frac{Af_{actual}}{Af_{theoritical}}$$

The volumetric efficiency is typically a function of engine speed, exhaust pressure, and manifold air pressure. For a locomotive type operation with steady state notch conditions, the only parameter, that varies, is the engine speed. If the breathing characteristic of the engine defined by the volumetric efficiency is calibrated, then the actual airflow can be calculated as:

$$Af_{actaul} = \frac{MAP \times V_d \times N}{R \times MAT \times 2 \times 60} \times \eta_{vol}(P_{exh}, P_{MAP}, N)$$

$$Af_{actaul} \cong \frac{MAP \times V_d \times N}{R \times MAT \times 2 \times 60} \times \eta_{vol}(\text{notch})\text{assuming steady state notch position}$$

where $P_{exh}$ is the exhaust pressure, $P_{MAP}$ is the manifold pressure, and N is the engine speed.

Figure 9:
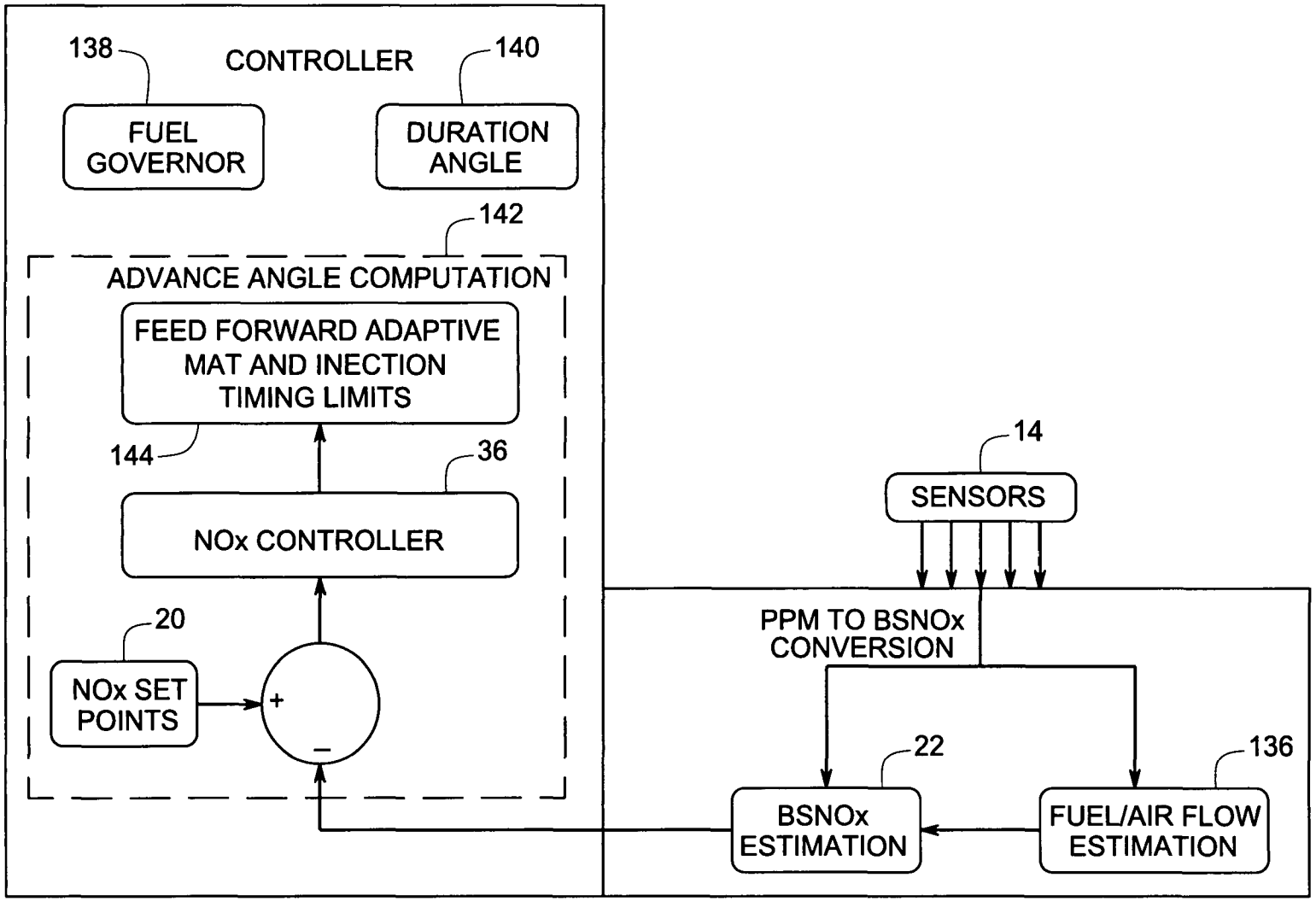
FIG. 9 is a diagrammatical representation of a control architecture for a brake specific nitrogen oxide emission in accordance with an exemplary embodiment of the present technique.

Referring to FIG. 9, a diagrammatical representation of BSNOx control architecture in accordance with aspects of FIG. 2 is illustrated. The electronic controller 16 is communicatively coupled to the sensors 14. The sensors 14 are configured to output a plurality of sensed parameters related to the engine to the controller 16. The controller 16 includes the emission estimator configured to estimate the actual brake specific nitrogen oxide emission levels based on the measured nitrogen oxide emissions in parts per million as represented by block 22. The controller 16 may also include a fuel estimator configured to estimate instantaneous fuel flow rate as represented by the block 136. The controller 16 may also include an air estimator configured to estimate volume of air flowing into the cylinders.

Further, in the illustrated embodiment, the controller 16 includes a fuel governor 138 configured to regulate fuel flow to the engine. In the illustrated embodiment, controller 16 may include a trade-off controller 36 configured to control the one or more control variables of the engine 12 so as to decrease specific fuel consumption by reducing a gap between the estimated brake specific nitrogen oxide emissions 22 and the predetermined target brake specific nitrogen oxide emissions 20 of the engine. The controller 16 is further configured to estimate the duration of valve opening time of the fuel injector coupled to the engine as represented by the block 140. In addition, the controller 16 estimates and regulates advance angle of the fuel injector i.e. start of fuel injection into the engine cylinder as represented by the block 142. In the illustrated embodiment, the advance angle is computed based on factors such as fuel injection timing, manifold air temperature, wheel slip, and transition from one notch to the other. The injection timing may be varied depending on changes in the manifold air temperature as represented by the block 144.

The controller 16 compares the estimated actual brake specific nitrogen oxide emission (BSNOX) levels with the predetermined target brake specific nitrogen oxide emission levels for each discrete notch among the plurality of throttle notches of the engine. In the illustrated embodiment, controller 16 also includes the trade-off controller 36 configured to control the one or more control variables such as fuel injection timing of the engine 12 so as to decrease specific fuel consumption by reducing a gap between the estimated brake specific nitrogen oxide emissions and the predetermined target brake specific nitrogen oxide emissions of the engine. The controller 36 varies the fuel injection timing based on a comparison of the estimated actual brake specific nitrogen oxide emission (BSNOX) levels and the predetermined target brake specific nitrogen oxide emission levels 20.

Figure 10:
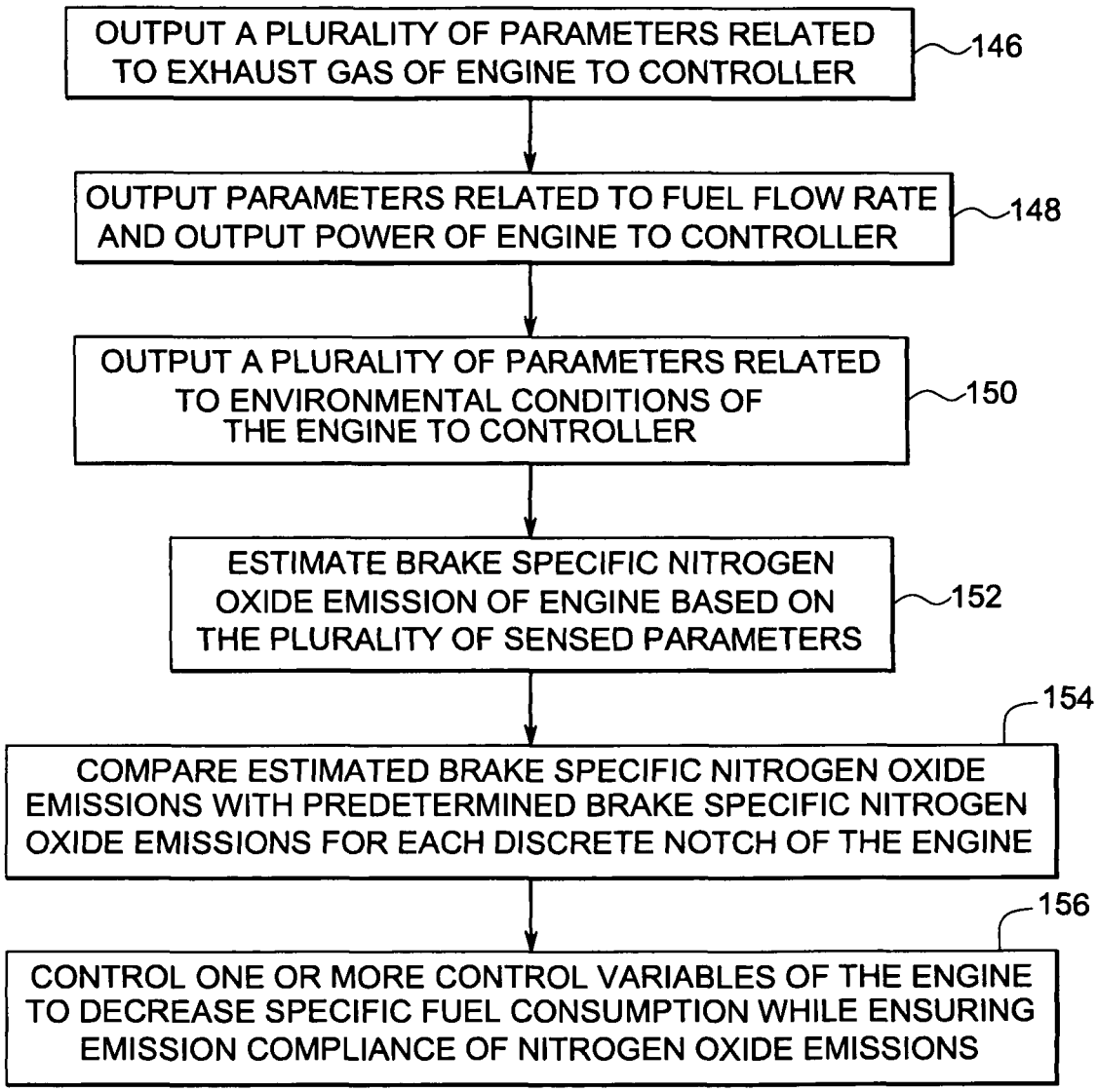
FIG. 10 is a flow chart illustrating exemplary steps involved in a process of controlling engine exhaust emission and fuel efficiency in accordance with an exemplary embodiment of the present technique.

Referring to FIG. 10, exemplary steps involved in a method of controlling engine exhaust emission and fuel efficiency in accordance with an exemplary embodiment of the present technique is illustrated. The method includes outputting a plurality of sensed parameters related to the engine to the controller. The controller receives a plurality of signals indicative of engine exhaust gas parameters including percentage of carbon dioxide, percentage of oxygen from an oxygen sensor, parts per million of nitrogen oxide emissions, parts per million of hydrocarbon, and parts per million of carbon monoxide from a carbon dioxide sensor, nitrogen oxide sensor, hydrocarbon sensor, and carbon monoxide sensor respectively as represented by the step 146. The controller also receives a flow rate signal from a fuel flow rate sensor and power signal from an output power sensor provided to the engine as represented by the step 148. In another exemplary embodiment, the controller also receives an air flow rate signal from air flow rate sensor and power signal from an output power sensor provided to the engine. The controller further receives a plurality of sensor signals indicative of environmental conditions of the engine such as ambient air temperature, relative humidity, and barometric pressure as represented by the step 150.

It should be noted that nitrogen oxide emissions include nitrogen oxide (NO), nitrogen dioxide (NO2), or the like. Since the NOx sensor detects the relative amount of NOx in the exhaust gas stream, the NOx measured in ppm is converted to brake specific nitrogen oxide emissions to compute the actual mass flow of NOx in the exhaust gas stream. The controller estimates the actual brake specific nitrogen oxide emission levels based on the plurality of sensed parameters as represented by the step 152.

The controller further calculates optimal target brake specific nitrogen oxide emission levels for each discrete notch of the engine so as to maintain an overall average weighted nitrogen oxide emissions within predetermined limits. In certain exemplary embodiments, the average weighted nitrogen oxide emissions are maintained at 5.5 grams per horse power-hour. Further, the controller compares the estimated actual brake specific nitrogen oxide emission (BSNOX) levels with the predetermined target brake specific nitrogen oxide emission levels for each discrete notch among a plurality of throttle notches of the engine as represented by the step 154. The controller 16 further controls the one or more control variables of the engine so as to decrease specific fuel consumption by reducing a gap between the estimated brake specific nitrogen oxide emissions and the predetermined target brake specific nitrogen oxide emissions of the engine as represented by the step 156.

If the estimated brake specific nitrogen oxide emission levels are less than the predetermined target brake specific nitrogen oxide emission levels, the controller generates control signals to control one or more control variables of the engine to increase fuel efficiency with resulting increase in emissions (but still within predefined limits). If the estimated brake specific nitrogen oxide emission levels is greater than the predetermined target brake specific nitrogen oxide emission levels, the controller generates control signals to control one or more control variables of the engine to reduce engine exhaust emissions with resulting decrease in fuel efficiency. It should be noted herein that the exemplary controller performs a closed-loop control of nitrogen oxide emissions of the engine so as decrease specific fuel consumption while ensuring emission compliance of the nitrogen oxide emissions. Moreover, the method of FIG. 10 and the logic illustrated in FIGS. 1-9 may be incorporated into a computer-readable medium, such as a computer, a computer disk, a memory chip, an electronic control unit (ECU) of the engine 12, or another tangible medium that can be read by a computer or the like. In certain embodiments, the logical steps of FIGS. 1-10 may be described as, or a part of, a computer-implemented method. Accordingly, the embodiments illustrated and described with reference to FIGS. 1-10 may include computer code, instructions, or logic that is readable and executable on a processor, programmable control unit (PCU), or the like.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system, comprising:

a controller configured to directly calculate a brake specific nitrogen oxide emission of an engine based on a plurality of sensed parameters using an oxygen-based technique, and configured to control one or more control variables of the engine to maintain the brake specific nitrogen oxide emissions within predetermined limits.

2. The system of claim 1, wherein the controller is configured to control the one or more control variables of the engine to decrease specific fuel consumption by reducing a gap between the calculated brake specific nitrogen oxide emission and the predetermined limits.

3. The system of claim 1, further comprising a plurality of sensors configured to output the plurality of sensed parameters to the controller.

4. The system of claim 3, comprising an engine, wherein the controller and the plurality of sensors are coupled to the engine.

5. The system of claim 4, further comprising a vehicle having the engine.

6. The system of claim 1, wherein the plurality of sensed parameters comprises exhaust gas parameters, wherein the exhaust gas parameters comprise percentage of carbon dioxide, parts per million of nitrogen oxide, parts per million of hydrocarbon, and parts per million of carbon monoxide.

7. The system of claim 1, wherein the plurality of sensed parameters comprises a fuel flow rate and an output power of the engine.

8. The system of claim 1, wherein the plurality of sensed parameters comprises environmental conditions of the engine, wherein the environmental conditions comprise an inlet air temperature, a relative humidity, and a barometric pressure.

9. The system of claim 1, wherein the controller is configured to compare the calculated brake specific nitrogen oxide emissions with a predetermined brake specific nitrogen oxide emission for each discrete notch among a plurality of throttle notches of the engine.

10. The system of claim 9, wherein the controller is configured to control one or more control variables of the engine to maintain the brake specific nitrogen oxide emissions within predetermined limits for each discrete notch among the plurality of throttle notches of the engine.

11. The system of claim 1, wherein the one or more control variables of the engine comprise fuel injection timing, or an inlet manifold air temperature, or a combination thereof of the engine.

12. The system of claim 1, wherein the controller is configured to calculate BSNOx estimation accuracy using a monte carlo analysis.

13. The system of claim 1, wherein the controller is configured to directly calculate the brake specific nitrogen oxide emission of the engine using stoichiometric analysis.

14. A computer-readable medium, comprising:

programming instructions disposed on the computer-readable medium, wherein the programming instructions comprises instructions to directly calculate a brake specific nitrogen oxide emission of an engine based on a plurality of sensed parameters using an oxygen-based technique, and instructions to control one or more control variables of the engine to maintain the brake specific nitrogen oxide emissions within predetermined limits.

15. The computer-readable medium of claim 14, comprising instructions to control the one or more control variables of the engine to decrease specific fuel consumption by reducing a gap between the calculated brake specific nitrogen oxide emission and the predetermined limits.

* * * * *